US006729785B2

(12) United States Patent
Wijerama

(10) Patent No.: US 6,729,785 B2
(45) Date of Patent: May 4, 2004

(54) METHOD AND DEVICE FOR ADVANCING A LEAD AND AN ERASER IN A MECHANICAL PENCIL AND FOR ADVANCING A PEN AND AN ERASER IN A PEN

(75) Inventor: Roshan Wijerama, Randolph, NJ (US)

(73) Assignee: Rose Art Industries, Inc., Livingston, NJ (US)

( * ) Notice: Subject to any disclaimer, the term of this patent is extended or adjusted under 35 U.S.C. 154(b) by 0 days.

(21) Appl. No.: 10/213,165

(22) Filed: Aug. 6, 2002

(65) Prior Publication Data

US 2004/0028451 A1 Feb. 12, 2004

(51) Int. Cl.[7] ..... B43K 24/08; B43K 29/05

(52) U.S. Cl. ..... 401/17; 401/19; 401/31; 401/34; 401/52; 401/81; 401/82; 401/104; 401/109

(58) Field of Search ..... 401/17, 19, 20, 401/31, 34, 52, 82, 117, 81, 104, 195, 109, 56; 15/429, 430, 433, 434

(56) References Cited

U.S. PATENT DOCUMENTS

| | | | | | |
|---|---|---|---|---|---|
| 1,104,514 | A | * | 7/1914 | Kilstrom | 401/52 X |
| 1,662,474 | A | * | 3/1928 | Randall | 15/429 |
| 3,897,160 | A | * | 7/1975 | Chaudoir et al. | 401/56 |
| 4,904,101 | A | | 2/1990 | Petterson | |
| 5,015,111 | A | | 5/1991 | Petterson | |
| 5,165,813 | A | | 11/1992 | Kageyama et al. | |
| 5,306,085 | A | | 4/1994 | Kobayashi | |
| 5,306,107 | A | | 4/1994 | Kageyama et al. | |
| 5,642,953 | A | | 7/1997 | Kobayashi et al. | |
| 5,927,882 | A | * | 7/1999 | Kageyama | 401/52 |
| 6,290,413 | B1 | | 9/2001 | Wang | |
| 6,309,129 | B1 | * | 10/2001 | Kageyama et al. | 401/104 |

* cited by examiner

*Primary Examiner*—Gregory L. Huson
*Assistant Examiner*—Kathleen J. Prunner
(74) *Attorney, Agent, or Firm*—Kenyon & Kenyon

(57) ABSTRACT

A mechanical pencil and/or pen and method for operating a mechanical pencil and/or pen is provided. The mechanical pencil includes a barrel, a lead chamber, a first pressure actuator, an eraser chamber, and a second pressure actuator. The first pressure actuator is situated on the outer surface and is coupled to the lead chamber. The lead chamber holds the lead and pressing the first pressure actuator advances the lead chamber causing the lead to advance. The second pressure actuator is situated on the outer surface and is coupled to the eraser chamber. The eraser chamber holds the eraser and pressing the second pressure actuator advances the eraser chamber causing the eraser to advance. A pen including a barrel, a pen chamber, an eraser chamber, and an eraser pressure actuator is also provided. The barrel includes a pen-end, an eraser-end, and an outer surface. The pen chamber is situated in the pen-end and holds the pen. The eraser chamber is situated in the eraser-end and holds an eraser. The eraser pressure actuator is situated on the outer surface and is coupled to the eraser chamber. Pressing the eraser pressure actuator advances the eraser chamber causing the eraser to advance. A method for operating a mechanical pencil includes pushing a first pressure actuator to advance a lead in a lead advance direction out a pencil nozzle and pushing a second pressure actuator to advance an eraser in an eraser advance direction out an eraser nozzle. Retracting the lead is achieved by depressing the first pressure actuator and applying pressure to a tip of the lead projecting out the pencil nozzle. Retracting the eraser is achieved by depressing the second pressure actuator and applying pressure to a tip of the eraser projecting out the eraser nozzle.

21 Claims, 5 Drawing Sheets

METHOD AND DEVICE FOR ADVANCING A LEAD AND AN ERASER IN A MECHANICAL PENCIL AND FOR ADVANCING A PEN AND AN ERASER IN A PEN

FIELD OF THE INVENTION

The present invention generally regards mechanical pencils and pens. More particularly, the present invention regards a mechanical pencil or pen that has a push-button to advance the lead or pen and a push-button to advance the eraser.

BACKGROUND INFORMATION

Mechanical pencils are discussed in various patents including U.S. Pat. No. 5,306,085 to Kobayashi et al., and U.S. Pat. No. 5,642,953 to Kobayashi et al., which discuss mechanical writing instruments including a mechanical pencil in combination with a ball point pen and an eraser. The eraser discussed in the Kobayashi references can be advanced and retracted by rotating the barrel around the eraser with respect to the remainder of the barrel.

U.S. Pat. No. 4,904,101 to Petterson and U.S. Pat. No. 5,015,111 to Petterson discuss mechanical pencils having erasers that are extended and retracted by angular displacement of a part of the barrel with respect to another part of the barrel.

U.S. Pat. No. 6,290,413 to Wang discusses a writing and/or erasing instrument having a slidable thrust device.

SUMMARY OF THE INVENTION

A mechanical pencil and a method for operating a mechanical pencil is provided. The mechanical pencil includes a barrel, a lead chamber, a first push-button, an eraser chamber, and a second push-button. The barrel includes a pencil-end, an eraser-end, and an outer surface. The lead chamber is situated in the pencil-end and holds a lead. The first push-button is situated on the outer surface and is coupled to the lead chamber. The eraser chamber is situated in the eraser-end and holds an eraser. The second push-button is situated on the outer surface and is coupled to the eraser chamber. Pressing the first push-button advances the lead chamber causing the lead to advance. Pressing the second push-button advances the eraser chamber causing the eraser to advance.

Another mechanical pencil is provided which includes an arrangement for holding a lead, a first push-button for advancing the arrangement for holding the lead, an arrangement for holding an eraser, and a second push-button for advancing the arrangement for holding the eraser. Pressing the first push-button advances the arrangement for holding the lead causing the lead to advance. Pressing the second push-button advances the arrangement for holding the eraser causing the eraser to advance.

A pen is provided which includes a barrel, a pen chamber, an eraser chamber, and an eraser push-button. The barrel includes a pen-end, an eraser-end, and an outer surface.

The pen chamber is situated in the pen-end and holds the pen point. The eraser chamber is situated in the eraser-end and holds an eraser. The eraser push-button is situated on the outer surface and is coupled to the eraser chamber. Pressing the eraser push-button advances the eraser chamber causing the eraser to advance.

A method for operating a mechanical pencil is provided which includes pushing a first push-button to advance a lead in a lead advance direction out a pencil nozzle and pushing a second push-button to advance an eraser in an eraser advance direction out an eraser nozzle. The lead is retracted by depressing the first push-button and applying pressure to a tip of the lead projecting out the pencil nozzle. The pressure is applied in a direction opposite the lead advance direction. The eraser is retracted by depressing the second push-button and applying pressure to a tip of the eraser projecting out the eraser nozzle. The pressure is applied in a direction opposite the eraser advance direction.

DETAILED DESCRIPTION

Figure 1A:
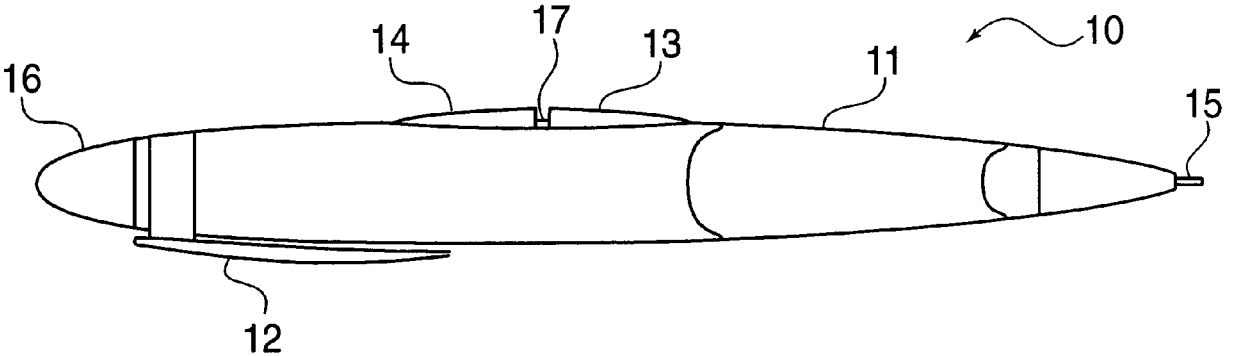
FIG. 1A illustrates a side view of an exemplary embodiment of a mechanical pencil according to the present invention.

FIG. 1A shows a side view of an exemplary embodiment of mechanical pencil 10. Mechanical pencil 10 has barrel 11 for holding mechanical pencil 10 by the fingers of a user and shirt clip 12 for holding mechanical pencil 10 in a shirt pocket. Also visible in FIG. 1A are the sides of pencil advance push-button 13 and eraser advance push-button 14. Pencil advance push-button 13 is situated near midpoint 17 of barrel 11 in the direction of pencil nozzle 15. Pencil nozzle 15 may be an end of barrel 11 with an open diameter equal to or greater than the diameter of the pencil lead. Eraser advance push-button 14 is situated near midpoint 17 of barrel 11 in the direction of eraser cap 16. Eraser cap 16 may be an end of barrel 11 that covers an eraser and may be removable manually or automatically. Eraser cap 16 may be removed completely or may be hinged to allow eraser cap 16 to be moved to the side to allow the eraser to be used. Alternative embodiments of eraser cap 16 are also possible.

Figure 1B:
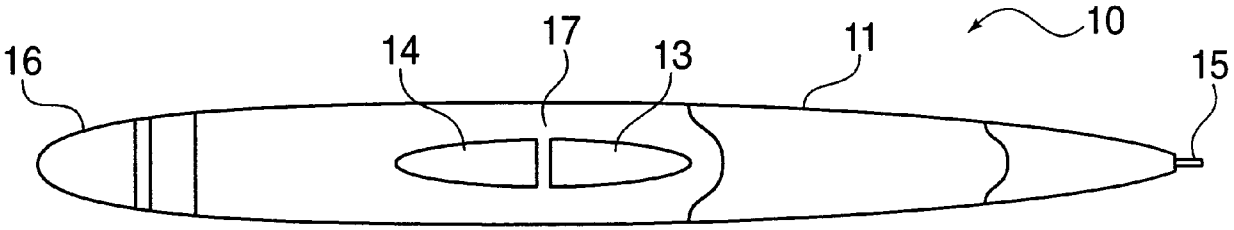
FIG. 1B illustrates a plan view of an exemplary embodiment of a mechanical pencil according to the present invention.

FIG. 1B shows a plan view of an exemplary embodiment of mechanical pencil 10. Mechanical pencil 10 has barrel 11 for holding by a user, pencil advance push-button 13 for advancing the lead of the pencil, and eraser advance push-button 14 for advancing the eraser of the pencil. Pencil advance push-button 13 is situated near midpoint 17 of barrel 11 in the direction of pencil nozzle 15, and eraser advance push-button 14 is situated near midpoint 17 of barrel 11 in the direction of eraser cap 16.

Figure 1C:
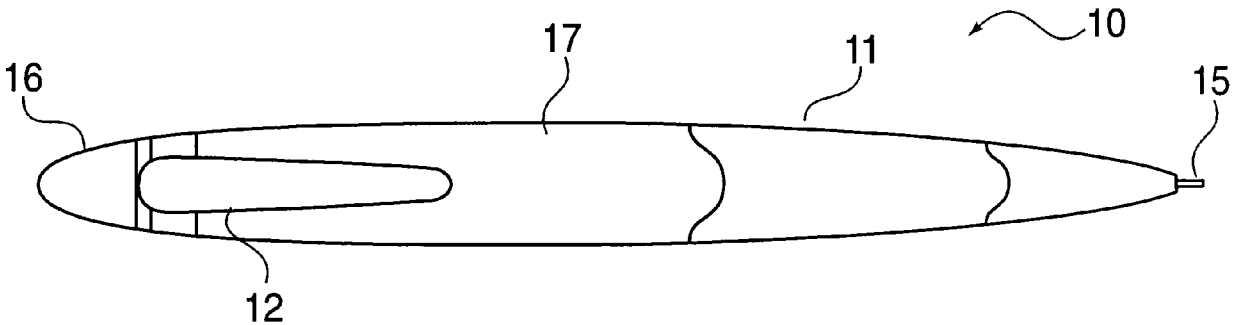
FIG. 1C illustrates a bottom view of an exemplary embodiment of a mechanical pencil according to the present invention.

FIG. 1C shows a bottom view of an exemplary embodiment of mechanical pencil 10. Mechanical pencil 10 includes barrel 11 having shirt clip 12 situated near eraser cap 16. Shirt clip 12 may operate to hold mechanical pencil 10 in a shirt pocket. In alternative exemplary embodiments, shirt clip 12 may operate as a push-button for advancing either the eraser or the lead. Shirt clip 12 may operate as a push-button by either depressing the end of shirt clip 12 closer to pencil nozzle 15 or by depressing the end of shirt clip 12 closer to eraser cap 16. Shirt clip 12 may be depressed to activate a push-button which may be external to barrel 11, may be flush with barrel 11, or may be accessible through a slot or hole in barrel 11. The slot or hole in barrel 11 may be adapted to accommodate shirt clip 12.

Figure 2A:
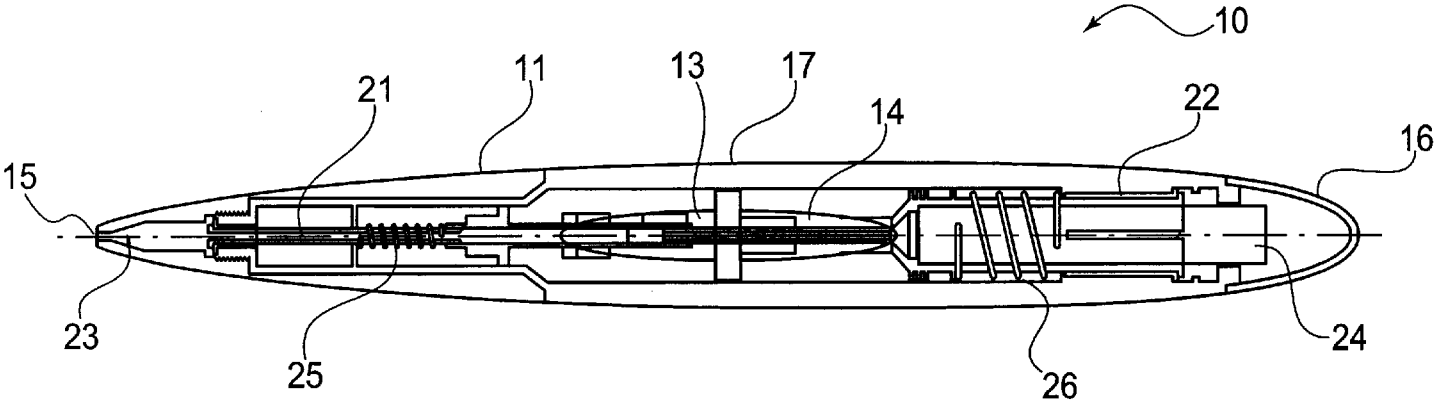
FIG. 2A illustrates a sectional plan view of an exemplary embodiment of a mechanical pencil according to the present invention.

FIG. 2A shows a sectional plan view of an exemplary embodiment of mechanical pencil 10. Pencil advance push-button 13 is situated near midpoint 17 of barrel 11 in the direction of pencil nozzle 15 and is coupled to pencil chamber 21. Pencil chamber 21 holds lead 23. Pencil chamber spring 25 acts on pencil chamber 21 to return pencil chamber 21 to a neutral position after advancing to an advance position when pencil advance push-button 13 is depressed. Eraser advance push-button 14 is situated near midpoint 17 of barrel 11 in the direction of eraser cap 16 and is coupled to eraser chamber 22. Eraser chamber 22 holds eraser 24. Eraser chamber spring 26 acts on eraser chamber 22 to return eraser chamber 22 to a neutral position after advancing to an advance position when eraser advance push-button 14 is depressed.

Figure 2B:
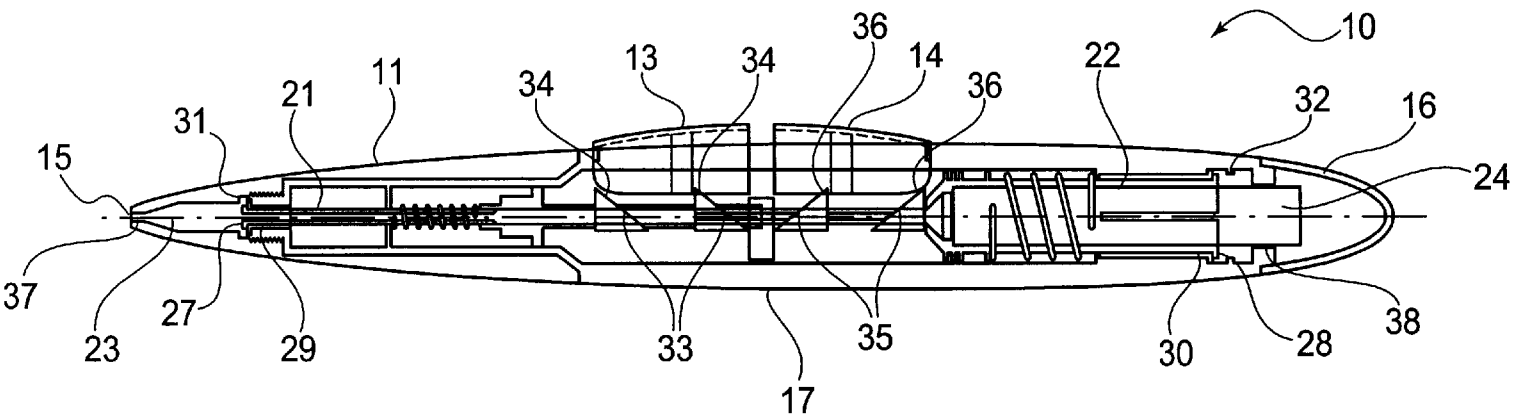
FIG. 2B illustrates a sectional side view of an exemplary embodiment of a mechanical pencil according to the present invention.

FIG. 2B shows a sectional side view of an exemplary embodiment of mechanical pencil 10. Lead friction-fit holder 27 holds lead 23 in a friction fit. Lead friction-fit holder 27 may be a two-part holder in a sandwich configuration, or may be any number of alternative configurations allowing a releasable friction fit of lead 23. Releasable lead sleeve 29 radially encloses lead friction-fit holder 27. Releasable lead sleeve 29 may provide a radially inward pressure on lead friction-fit holder 27 that may create the friction fit with lead 23. Releasable lead sleeve 29 may move forward with lead friction-fit holder 27 when the pencil chamber advances until releasable lead sleeve 29 contacts lead sleeve release stop 31. Lead sleeve release stop 31 may be situated on the inside of the pencil barrel and may be integrated in the barrel. When the pencil chamber is advanced by depressing pencil advance push-button 13, releasable lead sleeve 29, holding lead friction-fit holder 27 (and in turn holding lead 23) moves forward until it contacts lead sleeve release stop 31. Lead friction-fit holder 27 with lead 23 continues to advance when releasable lead sleeve 29 contacts lead sleeve release stop 31. As releasable lead sleeve 29 separates from lead friction-fit holder 27, the radially inward pressure on lead friction-fit holder 27 is reduced, thereby reducing the friction between lead friction-fit holder 27 and lead 23. Lead 23 passes out through pencil nozzle 15 through lead friction element 37. Lead friction element 37 interacts with lead 23 to provide a friction to the movement of lead 23 that is greater in the retracting direction (toward midpoint 17) than in the advancing direction (toward pencil nozzle 15). Therefore, when push-button 13 is released, pencil chamber spring 25 returns the pencil chamber to the neutral position and lead friction-fit holder 27 retracts. Lead 23 encounters an increased friction from lead friction element 37 and therefore either does not retract or retracts less than lead friction-fit holder 27. Lead friction element 37 may be an o-ring, and may be in particular a rubber o-ring. Lead friction-fit holder 27 retracts back into releasable lead sleeve 29 and thereby reacquires a friction fit with lead 23. The pencil chamber may be in a neutral position when lead friction-fit holder 27 retracts back into releasable lead sleeve 29 or may continue to retract to return to the neutral position. If the pencil chamber continues to retract, lead 23 may also retract slightly. During the advancing operation, when releasable lead sleeve 29 contacts lead sleeve release stop 31 releasing lead friction-fit holder 27, releasable lead sleeve 29 may thereafter retract slightly by any known method to a slightly more retracted position to await the return of lead friction-fit holder 27. In this manner, the pencil chamber may project lead 23 to an advance position when advancing, and then may reacquire a friction fit through lead friction-fit holder 27 and releasable lead sleeve 29 when retracting. The friction fit may be reacquired with lead 23 at a point on lead 23 further towards midpoint 17 upon retracting than the point on lead 23 where the friction fit was released when advancing.

Also shown in FIG. 2B is eraser friction-fit holder 28 holding eraser 24 in a friction fit. Eraser friction-fit holder 28 may be a two-part holder in a sandwich configuration, or may be any number of alternative configurations allowing a releasable friction fit of eraser 24. Releasable eraser sleeve 30 radially encloses eraser friction-fit holder 28. Releasable eraser sleeve 30 may provide a radially inward pressure on eraser friction-fit holder 28 that may create the friction fit with eraser 24. Releasable eraser sleeve 30 may move forward with eraser friction-fit holder 28 when the eraser chamber advances until releasable eraser sleeve 30 contacts eraser sleeve release stop 32. Eraser sleeve release stop 32 may be situated on the inside of the pencil barrel and may be integrated in the barrel. When the eraser chamber is advanced by depressing eraser advance push-button 14, releasable eraser sleeve 30, holding eraser friction-fit holder 28 (and in turn holding eraser 24) moves forward until it contacts eraser sleeve release stop 32. Eraser friction-fit holder 28 with eraser 24 continues to advance when releasable eraser sleeve 30 contacts eraser sleeve release stop 32, thereby reducing the radially inward pressure on eraser friction-fit holder 28. As releasable eraser sleeve 30 separates from eraser friction-fit holder 28, the radially inward pressure on eraser friction-fit holder 28 is reduced, thereby reducing the friction between eraser friction-fit holder 28 and eraser 24. Eraser 24 passes out through eraser friction element 38. Eraser friction element 38 interacts with eraser 24 to provide a friction to the movement of eraser 24 that is greater in the retracting direction (toward midpoint 17) than in the advancing direction (toward eraser cap 16). Therefore, when push-button 14 is released, eraser chamber spring 26 returns the eraser chamber to the neutral position and eraser friction-fit holder 28 retracts. Eraser 24 encounters an increased friction from eraser friction element 38 and therefore either does not retract or retracts less than eraser friction-fit holder 28. Eraser friction element 38 may be an o-ring, and may be in particular a rubber o-ring. Eraser friction-fit holder 28 retracts back into releasable eraser sleeve 30 and thereby reacquires a friction fit with eraser 24. The eraser chamber may be in a neutral position when eraser friction-fit holder 28 retracts back into releasable eraser sleeve 30 or may continue to retract to return to the neutral position. If the eraser chamber continues to retract, eraser 24 may also retract slightly. During the advancing operation, when releasable eraser sleeve 30 contacts eraser sleeve release stop 32 releasing eraser friction-fit holder 28, releasable eraser sleeve 30 may thereafter retract slightly by any known method to a slightly more retracted position to await the return of eraser friction-fit holder 28. In this manner, the eraser chamber may project eraser 24 to an advance position when advancing, and then may reacquire a friction fit through eraser friction-fit holder 28 and releasable eraser sleeve 30 when retracting. The friction fit may be reacquired with eraser 24 at a point on eraser 24 further towards midpoint 17 upon retracting than the point on eraser 24 where the friction fit was released when advancing.

FIG. 2B shows the mechanism for advancing lead 23 using pencil advance push-button 13 and advancing eraser 24 using eraser advance push-button 14. Pencil advance push-button 13 is coupled to pencil push-button ramps 34. Two pencil push-button ramps 34 are shown in FIG. 2B, however more or fewer pencil push-button ramps 34 are possible. Each pencil push-button ramp 34 engages a lead chamber ramp 33. Therefore, the number of pencil push-button ramps 34 may equal the number of lead chamber ramps 33. Pencil advance push-button 13 may be prevented from moving in the direction of pencil nozzle 15 and/or eraser cap 16 by the sidewalls of the slot in barrel 11. Therefore, when pencil advance push-button 13 is depressed, pencil push-button ramps 34 impart a force to lead chamber 21 via lead chamber ramps 33. As pencil push-button ramps 34 press down on lead chamber ramps 33, the mutually opposing ramps slide against each other causing lead chamber 21 to advance toward pencil nozzle 15.

Similarly, eraser advance push-button 14 is coupled to eraser push-button ramps 36. Two eraser push-button ramps 36 are shown in FIG. 2B, however more or fewer eraser push-button ramps 36 are possible. Each eraser push-button ramp 36 engages an eraser chamber ramp 35. Therefore, the number of eraser push-button ramps 36 may equal the number of eraser chamber ramps 34. Eraser advance push-button 13 may be prevented from moving in the direction of eraser cap 16 and/or pencil nozzle 15 by the sidewalls of the slot in barrel 11. Therefore, when eraser advance push-button 14 is depressed, eraser push-button ramps 36 impart a force to eraser chamber 22 via eraser chamber ramps 35. As eraser push-button ramps 36 press down on eraser chamber ramps 35, the mutually opposing ramps slide against each other causing eraser chamber 22 to advance toward eraser cap 16.

Figure 3A:
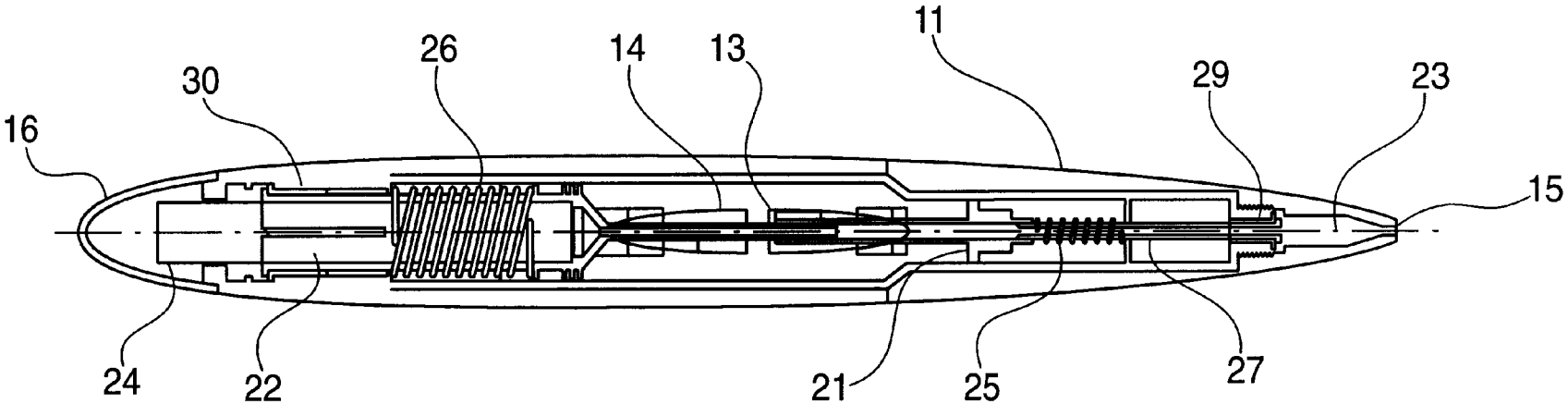
FIG. 3A illustrates a sectional plan view of an exemplary embodiment of a mechanical pencil according to the present invention.

FIG. 3A shows a sectional plan view of an exemplary embodiment of a mechanical pencil according to the present invention. Mechanical pencil 10 includes barrel 11 having pencil advance push-button 13 and eraser advance push-button 14. Pencil chamber 21 is coupled to pencil advance push-button 13 and operates to advance lead 23 towards pencil nozzle 23. Lead friction-fit holder 27 and releasable lead sleeve 29 operate to hold lead 23. Pencil chamber spring 25 operates to return pencil chamber 21 to a neutral position after pencil chamber 21 is advanced by pressing pencil advance push-button 13. Eraser chamber 22 is coupled to eraser advance push-button 14 and operates to advance eraser 24 towards eraser cap 16. Eraser friction-fit holder 28 and releasable eraser sleeve 30 operate to hold eraser 24. Eraser chamber spring 26 operates to return eraser chamber 22 to a neutral position after eraser chamber 22 is advanced by pressing eraser advance push-button 14.

Figure 3B:
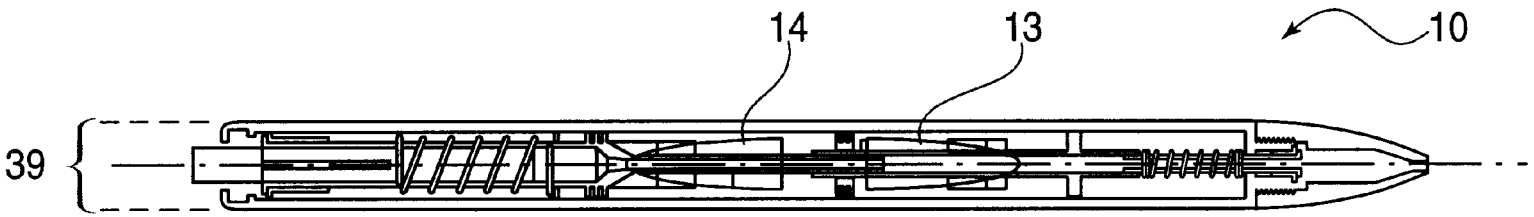
FIG. 3B illustrates a sectional plan view of another exemplary embodiment of a mechanical pencil according to the present invention.

FIG. 3B shows a sectional plan view of another exemplary embodiment of a mechanical pencil according to the present invention. Mechanical pencil 10 of FIG. 3B has a smaller diameter 39 than the previous embodiments. Mechanical pencil 10 of FIG. 3B may have a shorter length than the previous embodiments.

Figure 4:
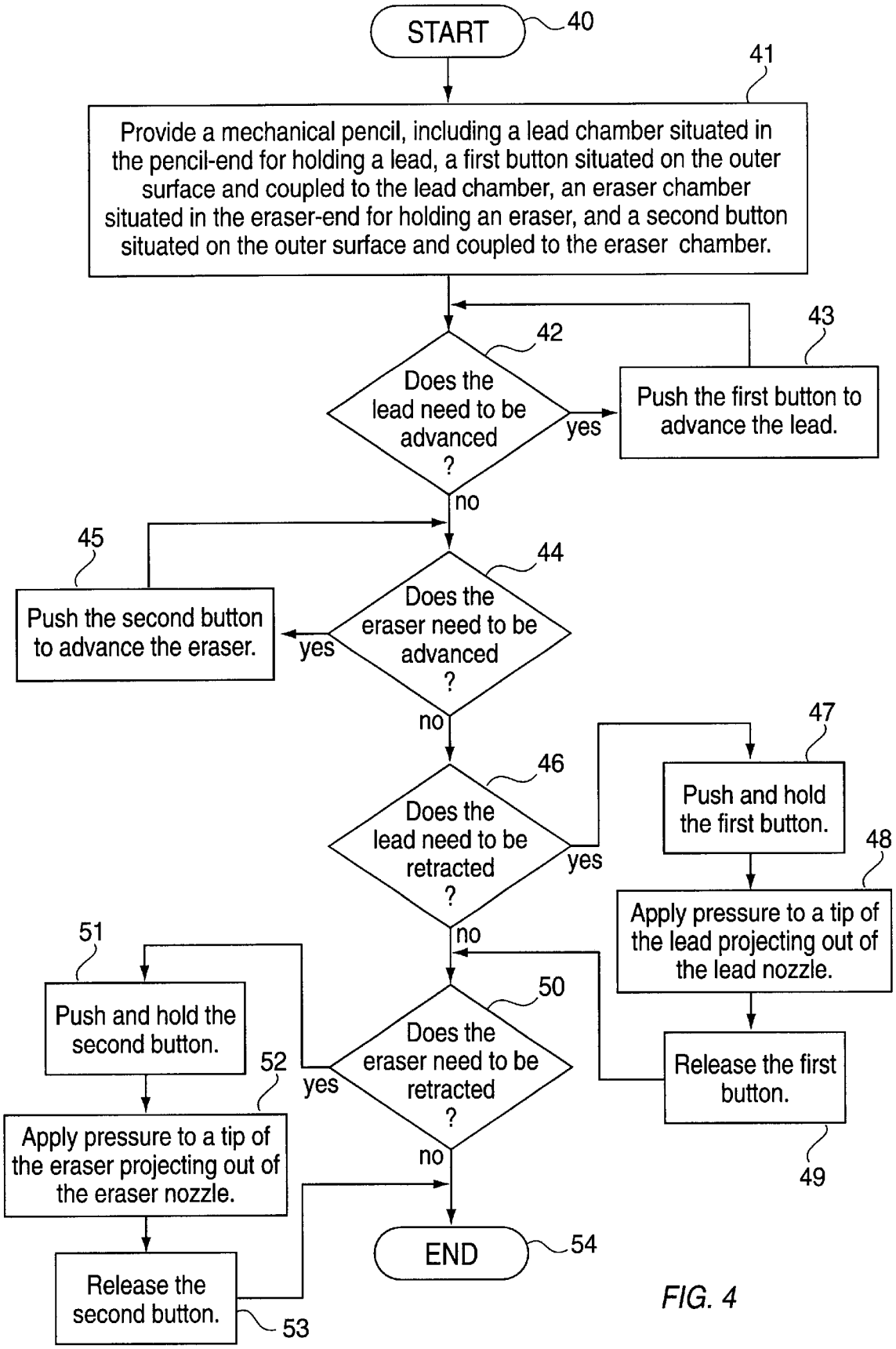
FIG. 4 is a flowchart illustrating an exemplary method according to the present invention.

FIG. 4 is a flowchart illustrating an exemplary method according to the present invention. The method shown in FIG. 4 begins in Start 40 and moves to operation 41 which indicates to provide a mechanical pencil. The mechanical pencil includes a lead chamber situated in the pencil-end for holding a lead, a first button situated on the outer surface and coupled to the lead chamber, an eraser chamber situated in the eraser-end for holding an eraser, and a second button situated on the outer surface and coupled to the eraser chamber. From operation 41, the flow proceeds to query 42, which asks whether the lead needs to be advanced. If the answer to query 42 is affirmative, the flow proceeds to operation 43, in which it is indicated to push the first button to advance the lead. From operation 43, the flow returns to query 42 to ask again whether the lead needs to be advanced. If the answer to query 42 is negative, the flow proceeds to query 44, which asks whether the eraser needs to be advanced. If the answer to query 44 is affirmative, the flow proceeds to operation 45, in which it is indicated to push the second button to advance the eraser. From operation 45, the flow returns to query 44 to ask again whether the eraser needs to be advanced. If the answer to query 44 is negative, the flow proceeds to query 46, which asks whether the lead needs to be retracted. If the answer to query 46 is affirmative, the flow proceeds to operation 47, in which it is indicated to push and hold the first button. From operation 47, the flow proceeds to operation 48, in which it is indicated to apply pressure to a tip of the lead projecting out the pencil nozzle. From operation 48, the flow proceeds to operation 49, in which it is indicated to release the first button. From operation 49, the flow proceeds to query 50 to ask whether the eraser need to be retracted. If the answer to query 46 is negative, the flow proceeds directly to query 50. If the answer to query 50 is affirmative, the flow proceeds to operation 51, in which it is indicated to push and hold the second button. From operation 51, the flow proceeds to operation 52, in which pressure is applied to a tip of the eraser projecting out the eraser nozzle. From operation 52, the flow proceeds to operation 53, in which the second button is released. From operation 53, the flow proceeds to End 54. If the answer to query 50 is affirmative, the flow proceeds directly to End 54.

Alternatively, the method shown in FIG. 4 may be used with a pen according to the present invention. A pen according to the present invention may use erasable ink which may be erasable by the eraser. The pen may include a ballpoint which is advanceable by a push-button and retractable by the same push-button. Depressing the push-button one time may advance the ballpoint, and depressing the push-button a second time may retract the ballpoint. Alternatively, the ballpoint may be advanced by rotating the end of the barrel at the pen-end with respect to the opposite end of the barrel. In this case, the ballpoint may be retracted by rotating the end of the barrel in the opposite direction.

Figure 5:
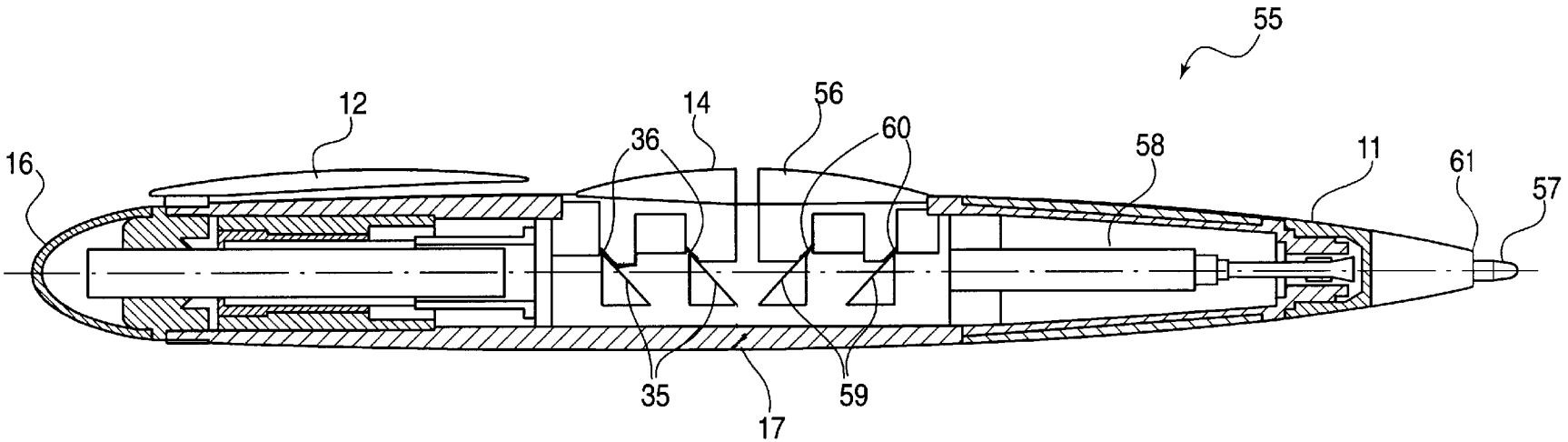
FIG. 5 illustrates a sectional side view of an exemplary embodiment of a pen according to the present invention.

FIG. 5 shows a sectional side view of an exemplary embodiment of a pen according to the present invention. Pen 55 may have an eraser advance push-button 14 and a pen advance push-button 56. Eraser advance push-button 14 may operate in a similar fashion to that described above in conjunction with the mechanical pencil according to an exemplary embodiment of the present invention. In particular, pressing eraser advance push-button 14 may operate to engage eraser push-button ramps 36 with eraser chamber ramps 35 to advance the eraser chamber and to thereby advance the eraser towards eraser cap 16. Pen advance push-button 56 may operate to engage pen push-button ramps 60 with pen chamber ramps 59 to advance pen chamber 58 and to thereby advance pen tip 57. Additionally, pen advance push-button 56 may have a toggle system to lock pen chamber 58 in an advanced position. In this situation, a subsequent pressing of pen advance push-button 56 may operate to unlock pen chamber 58 to retract pen tip 57. Alternatively, pen tip 57 may be advanced by rotating the end of barrel 11 towards pen nozzle 61 with respect to the end of barrel 11 towards eraser cap 16.

A mechanical pencil is provided herein. While several embodiments have been discussed, others, within the invention's spirit and scope, are also plausible. For example, a drum for spare pencil leads may be provided in the barrel of the pencil. In this alternative embodiment, a chamber for spare leads is provided in the barrel which is able to feed leads into the lead chamber when a new lead is required. Alternative embodiments are also possible in which the pen is advanced by rotating the barrel and the eraser is advanced by pressing the shirt clip.

What is claimed is:

1. A mechanical pencil, comprising:

a barrel including a pencil-end, an eraser-end, and an outer surface;

a lead chamber situated in the pencil-end adapted to hold a lead;

a pencil advancing arrangement coupled to the lead chamber;

an eraser chamber situated in the eraser-end adapted to hold an eraser; and a first pressure actuator situated on the outer surface and coupled to the eraser chamber;

wherein actuating the pencil advancing arrangement advances the lead chamber;

wherein pressing the first pressure actuator advances the eraser chamber;

wherein the first pressure actuator is coupled to the eraser chamber by at least one first pressure actuator ramp situated on the first pressure actuator and at least one eraser chamber ramp situated on the eraser chamber; and wherein depressing the first pressure actuator causes the at least one first pressure actuator ramp to engage the at least one eraser chamber ramp causing an eraser advance force to advance the eraser chamber.

2. The mechanical pencil of claim 1, wherein a shirt clip situated on the outer surface of the barrel includes at least one of the pencil advancing arrangement and the first pressure actuator.

3. The mechanical pencil of claim 2, wherein:

the shirt clip includes the first pressure actuator; and the shirt clip and the pencil advancing arrangement are situated co-linearly with a pencil nozzle and an eraser nozzle, the pencil nozzle situated on the pencil-end of the barrel and the eraser nozzle situated on the eraser-end of the barrel.

4. The mechanical pencil of claim 1, wherein the first pressure actuator and the pencil advancing arrangement are situated co-linearly with a pencil nozzle and an eraser nozzle, the pencil nozzle situated on the pencil-end of the barrel and the eraser nozzle situated on the eraser-end of the barrel.

5. The mechanical pencil of claim 4, wherein:

the first pressure actuator is situated near a mid-line of the barrel, the mid-line representing a plurality of points on the outer surface equidistant from the pencil nozzle and the eraser nozzle, the first pressure actuator situated on the eraser-end side of the mid-line; and the pencil advancing arrangement is situated near the mid-line of the barrel, the pencil advance arrangement situated on the pencil-end side of the mid-line.

6. The mechanical pencil of claim 1, wherein:

the lead advances towards and out a pencil nozzle situated on the pencil-end of the barrel; and the eraser advances towards and out an eraser nozzle situated on the eraser-end of the barrel.

7. The mechanical pencil of claim 6, wherein:

the lead chamber includes a lead friction-fit holder radially enclosing the lead and a releasable lead sleeve radially enclosing the lead friction-fit holder;

the penzil nozzle includes a lead sleeve release stop; and the lead chamber advancing causes the releasable lead sleeve to engage the lead sleeve release stop causing the releasable lead sleeve to release the lead friction-fit holder.

8. The mechanical pencil of claim 7, wherein:

the pencil nozzle includes a lead friction element;

the lead friction element interacts with the lead when the lead advances out the pencil nozzle, the lead friction element providing a friction coefficient in a pencil outward direction and another friction coefficient in an eraser outward direction, the eraser outward direction opposite the pencil outward direction; and the friction coefficient is less than the other friction coefficient.

9. The mechanical pencil of claim 7, wherein the lead friction-fit holder includes a top part and a bottom part situated in a sandwich configuration.

10. The mechanical pencil of claim 6, wherein:

the eraser chamber includes an eraser friction-fit holder radially enclosing the eraser and a releasable eraser sleeve radially enclosing the eraser friction-fit holder;

the eraser nozzle includes an eraser sleeve release stop; and the eraser chamber advancing causes the releasable eraser sleeve to engage the eraser sleeve release stop causing the releasable eraser sleeve to release the eraser friction-fit holder.

11. The mechanical pencil of claim 10, wherein:

the eraser nozzle includes an eraser friction element, wherein:

the eraser friction element interacts with the eraser when the eraser advances out the eraser nozzle, the eraser friction element providing a friction coefficient in an eraser outward direction and another friction coefficient in a pencil outward direction, the pencil outward direction opposite the eraser outward direction; and the friction coefficient is less than the other friction coefficient.

12. The mechanical pencil of claim 10, wherein the eraser friction-fit holder includes a top part and a bottom part situated in a sandwich configuration.

13. The mechanical pencil of claim 1, wherein the pencil advancing arrangement includes at least one of a second pressure actuator, a rotatable advance arrangement, and a slide advance arrangement.

14. The mechanical pencil of claim 13, wherein the pencil advancing arrangement includes the second pressure actuator, the second pressure actuator situated on at least one of the outer surface and the eraser-end.

15. The mechanical pencil of claim 13, wherein:

the second pressure actuator is coupled to the lead chamber by at least one second pressure actuator ramp situated on the second pressure actuator and at least one lead chamber ramp situated on the lead chanber; and depressing the second pressure actuator causes the at least one second pressure actuator ramp to engage the at least one lead chamber ramp causing a lead advance force to advance the lead chamber.

16. The mechanical pencil of claim 15, further comprising a lead chamber spring applying a lead retract force to the lead chamber opposite the lead advance force, the lead chamber spring returning the lead chamber to a lead chamber neutral position when the second pressure actuator is released.

17. The mechanical pencil of claim 16, wherein the lead may be retracted into the barrel by applying pressure to a tip of the lead projecting out the pencil nozzle in a direction opposite a pencil outward direction while the second pressure actuator is depressed.

18. The mechanical pencil of claim 1, further comprising an eraser chamber spring applying an eraser retract force to the eraser chamber opposite the eraser advance force, the eraser chamber spring returning the eraser chamber to an eraser chamber neutral position when the first pressure actuator is released.

19. The mechanical pencil of claim 18, wherein the eraser may be retracted into the barrel by applying pressure to a tip of the eraser projecting out the eraser nozzle in a direction opposite an eraser outward direction while the first pressure actuator is depressed.

20. The mechanical pencil of claim 1, further comprising an eraser cap, the eraser cap operable to cover and uncover the eraser.

21. A method for operating a mechanical pencil, comprising:

pushing a first pressure actuator in a direction to advance an eraser in an eraser advance direction out an eraser nozzle;

pushing a second pressure actuator to advance a lead in a lead advance direction out a pencil nozzle;

retracting the eraser by depressing in the direction the first pressure actuator and applying pressure to a tip of the eraser projecting out the eraser nozzle, the pressure applied in a first direction opposite the eraser advance direction; and retracting the lead by depressing the second pressure actuator and applying pressure to a tip of the lead projecting out the pencil nozzle, the pressure applied in a second direction opposite the lead advance direction.

* * * * *